US006186226B1

(12) United States Patent
Robertson

(10) Patent No.: US 6,186,226 B1
(45) Date of Patent: Feb. 13, 2001

(54) BOREHOLE CONDUIT CUTTING APPARATUS

(76) Inventor: Michael C. Robertson, P.O. Box 2499, Burleson, TX (US) 76097

( * ) Notice: Under 35 U.S.C. 154(b), the term of this patent shall be extended for 0 days.

(21) Appl. No.: 09/304,655

(22) Filed: May 4, 1999

(51) Int. Cl.[7] ..... E21B 29/00
(52) U.S. Cl. ..... 166/55; 166/297
(58) Field of Search ..... 166/55, 297

(56) References Cited

U.S. PATENT DOCUMENTS

| | | | | |
|---|---|---|---|---|
| 4,298,063 | | 11/1981 | Regalbuto et al. . | |
| 4,345,646 | * | 8/1982 | Terrell | 166/55 |
| 4,352,397 | * | 10/1982 | Christopher | 166/297 |
| 4,494,601 | * | 1/1985 | Pratt et al. | 166/55 |
| 4,598,769 | | 7/1986 | Robertson . | |
| 5,435,394 | | 7/1995 | Robertson . | |

* cited by examiner

*Primary Examiner*—David Bagnell
*Assistant Examiner*—Jennifer M Hawkins
(74) *Attorney, Agent, or Firm*—Arthur F Zobal

(57) ABSTRACT

The apparatus of the invention is used for severing a metal conduit disposed in a borehole extending downward into the earth. The apparatus includes a body adapted to be lowered into the metal conduit to be severed. The body is formed by a surrounding wall defining an elongated chamber with a central axis and having a lower portion, an intermediate portion, and an upper portion. The lower portion defines a cavity with a plurality of apertures extending through the wall in a given plane at angularly spaced apart positions located 360° around the axis for providing passages from said cavity to the outside of the wall. A combustible charge is located in the intermediate portion, and a movable seal member is located in the cavity above the apertures and below the combustible charge. An ignition device is coupled to the upper portion for igniting the combustible charge for creating a flame and hot combustion products for moving the movable seal member below the apertures for passage of the flame and hot combustion products into the cavity and out of the apertures for severing the surrounding metal conduit.

20 Claims, 1 Drawing Sheet

Fig.1
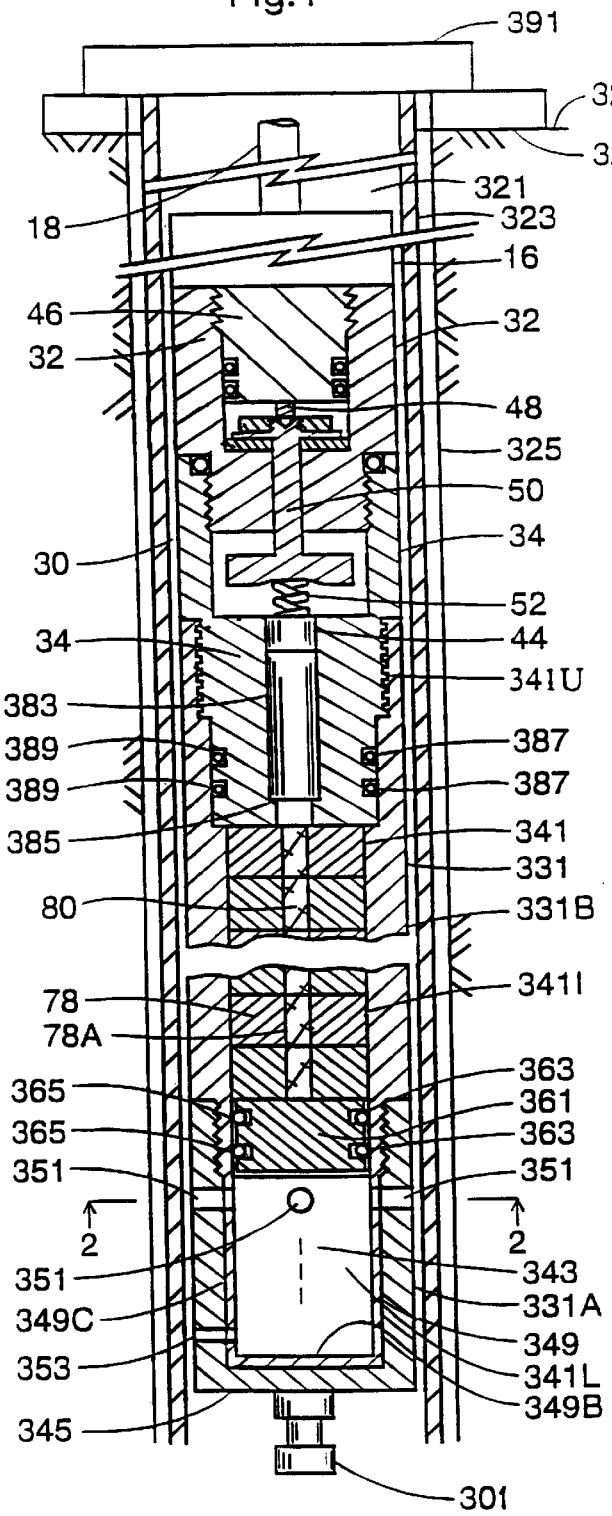
Fig.2
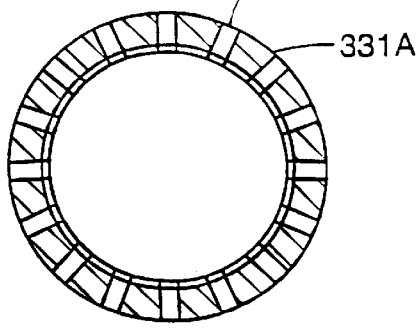
Fig.3
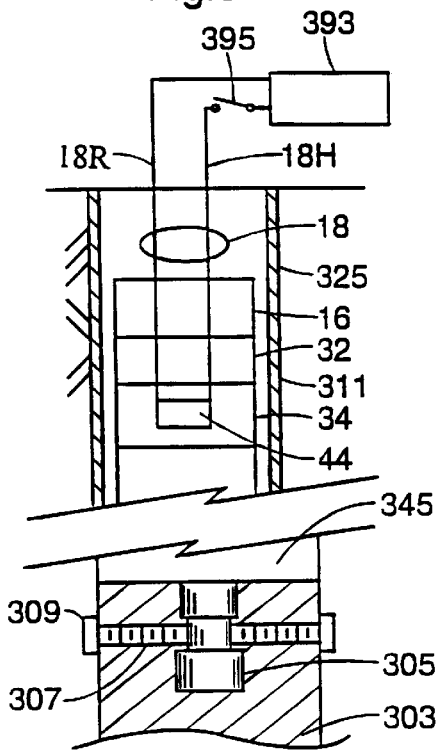
Fig.4

BOREHOLE CONDUIT CUTTING APPARATUS

BACKGROUND OF THE INVENTION

1. Field of the Invention

The invention relates to an apparatus for cutting conduit located in a borehole formed in the earth.

2. Description of the Prior Art

U.S. Pat. Nos. 4,298,063, 4,598,769, and 5,435,394 disclose apparatus for cutting or severing conduit located in a borehole formed in the earth. U.S. Pat. Nos. 4,598,769 and 5,435,394 are incorporated into this application by reference.

SUMMARY OF THE INVENTION

It is an object of the invention to provide a new and useful apparatus for cutting or severing a conduit located in a borehole formed in the earth. The conduit may be a drill pipe, production tubing, coiled tubing, casing, etc. The apparatus of the invention comprises a body adapted to be lowered into the conduit located in the borehole. The body comprises a surrounding wall defining an elongated chamber having a lower portion, an intermediate portion, and an upper portion. The lower portion defines a cavity with a plurality of angularly spaced apart apertures extending through the wall of the body. A moveable seal means is located in the cavity between the apertures and the lower end of the intermediate portion. A combustible charge is located in the intermediate portion and an ignition means is coupled to the upper portion for igniting the combustible charge for creating a flame and hot combustion products for moving the seal means below the apertures for passage of the flame into the cavity and out of the apertures for cutting or severing the surrounding conduit.

BRIEF DESCRIPTION OF THE DRAWINGS

FIG. 1 is a cross-section of the radial cutting apparatus of the invention.

FIG. 2 is a cross-section of FIG. 1 taken along the lines 2—2 thereof.

FIG. 3 schematically illustrates the electrical system of the apparatus of FIG. 1.

FIG. 4 illustrates an anchor coupled to an anchor connecting stud of the apparatus of FIG. 1.

DESCRIPTION OF THE PREFERRED EMBODIMENTS

Referring now to the drawings, the apparatus of the invention is identified by reference numeral 321. It is shown located in metal drill pipe 323 located in a borehole 325 extending into the earth 327 from the surface 329. One of the purposes of the apparatus 321 is to cut or sever the drill pipe 323 in the event it become stuck in the borehole to allow remedial action to take place.

The apparatus 321 comprises an annular metal wall 331 formed by annular metal sections 331A and 331B and an ignition subassembly 30 comprising members 34 and 32 screwed together as shown to form a chamber 341 having a central axis 343. The chamber 341 comprises a lower portion 341L, an intermediate portion 341(I), and an upper portion 341U. A lower round wall 345 is connected to the lower end of wall portion 331A. The lower chamber portion 341L defines a cylindrical cavity with heat resistant liner 349 formed of carbon. The liner 349 comprises a cylindrical side wall 349C and a round bottom wall 349B. A plurality of nozzles apertures 351 are formed through the wall portion 331A and the liner side wall 349C. The apertures 351 are angularly spaced apart about the axis 343 as shown in FIGS. 1 and 2. Fifteen apertures 351 are shown, in FIG. 2, however, more or less apertures 351 may be formed through walls 331A and 349C in a plane perpendicular to the axis 343. Lower aperture 353 is a bleed or damper aperture.

A slidable cylindrical metal piston or seal member 361 is located in the upper portion of the cavity 341L above the apertures 351. Sealing O-rings 363 in annular slots 365 and liquid pressure in the cavity 341L initially hold the seal member 361 in its upper position. Liquid from the borehole can flow into the cavity 341L by way of apertures 351, when the apparatus is located in the borehole.

Located in the intermediate portion 341(I) of the chamber 341 and supported by the upper wall of the seal members 361 are a plurality of combustible pyrotechnic charges 78 made from conventional material which is compressed into donut shaped pellets. Each of the charges has a cylindrical outer surface and a central aperture 78A extending therethrough. The charges 78 are stacked on top of each other within the annular inside wall of portion 33 1B with the lower charge 78 supported by the seal member 361 and with the apertures 78A in alignment. Loosely packed combustible material 80 preferably of the same material used in forming the charges 78 is located within the apertures 78A of the charges 78 such that each charge is ignited from the loosely packed combustible material upon ignition by an ignition means 44.

The ignition means 44 is supported in a central aperture 383 of the lower portion of member 34 by shoulder 385 of member 34 and which lower portion is screwed into the upper portion 341U of the wall 331B. The aperture 383 extends completely through the lower portion of member 34. Members 387 are sealing O-rings located in annular grooves 389. The ignition means 44 comprises an electrical resistor that is heated by an electrical current applied thereto from the surface.

The member 32 is coupled to an a cable head assembly 16. Members 30, 34, and 32 are similar to those disclosed in U.S. Pat. No. 4,598,769. A wireline cable 18 is coupled to the upper end of the assembly 16 and extends to the surface to apparatus 391 which includes a reel employed for unwinding and winding the cable 18 to lower and raise the apparatus 321. The apparatus 391 also includes a source 393 of electrical power for applying electrical current to the ignition means 44 by way of electrically insulated lead 18H of cable 18 as shown schematically in FIG. 3. Lead 18R is an electrically insulated ground or return lead coupled to the ignition means 44. An uphole switch shown schematically at 395 is employed to couple and uncouple the source 393 to and from the ignition means 44 to energize and de-energize the ignition means 44. Lead 18H is electrically coupled to the ignition means 44 by way of an electrode probe 46, a prong 48, conductor 50, and spring 52 as disclosed in U.S. Pat. No. 4,598,769. The members 46, 48, 50, and 52 are electrically insulated to prevent a short from occurring. This ignition system may be defined as an electric line firing system.

When the ignition means 44 is energize by electrical current, it generates enough heat to ignite the material 80 and hence the charges 78 to generate a very high temperature flame with other hot combustion products and pressure that forces the seal member 361 downward below apertures 351 to allow the high temperature flame to flow out of the cavity of the lower chamber portion 341L by way of the apertures 351 and to the pipe 323 to cut or sever the pipe 323 at the level of the apertures.

The aperture 353 acts as a damper to allow the liquid below the seal member 361 to slowly flow out into the borehole and hence prevents the seal member 361 from slamming open against the bottom wall 345, 349B which may otherwise damage the bottom of the apparatus.

After the pipe has been severed, the apparatus 321 is removed from the borehole, allowing the upper portion of the drill pipe to be removed and the lower portion of the drill pipe then drilled out in the event that the drill pipe 323 had become stuck in the borehole.

In one embodiment, the outside diameter of section 331B may be 1 inch with 15 equally spaced apart apertures 351 around the axis 343 formed through the wall of member with each apertures 351 having a diameter of about 0.060. It is to be understood, however, that these specifications may vary.

The apparatus 321 also may be used to cut or sever conventional metal production tubing, metal coiled tubing, or metal casing in a borehole for remedial purposes. In FIG. 3, the apparatus 321 shown is employed to cut or sever metal casing 311 located in the borehole 325.

In FIG. 1, there is shown an anchor stud 301 connected to the bottom wall 345 of the apparatus to which a pressure balance anchor assembly may be coupled which may be of the type disclosed in U.S. Pat. No. 5,435,394. Referring to FIG. 4, there is illustrated an anchor 303 coupled to the anchor stud 301. The anchor 303 has an aperture 305 for receiving the stud 301 and set-screw holes 307 for receiving set screws 309 for coupling the anchor 303 to the stud 301.

In another embodiment, a slickline battery firing system may be employed in lieu of the electric line firing system to energize the ignition means 44. This system comprises a slickline cable connection for supporting the modified apparatus 321 and which is connected to a pressure firing head. The pressure firing head comprises a metal piston having a larger diameter head with a smaller diameter metal rod extending downward from the bottom of the larger diameter head. The piston is slidably located in a hollow cylinder. A spring surrounding the rod is employed to provide upward pressure against the under side of the larger diameter head. The spring is adjustable to allow for hydrostatic compensation of well fluids so that the system does not fire at bottom hole pressure. When the piston is moved downward, the lower end of the rod will make contact with an electrical lead from the battery pack and electrical lead coupled to one side of the ignition means (the minus terminal of the battery pack and the other side of the ignition means 44 are grounded) to discharge current to the ignition means to ignite the material 80 and fire the combustible charges 78. Fluid ports extend through the wall of the cylinder above the larger diameter piston head. When the borehole apparatus is in place in the borehole ready to cut the metal conduit, a pump at the surface increases the fluid pressure in the conduit and moves the piston downward against the pressure of the spring to allow the rod to make electrical contact with the leads to fire the combustible charges 78.

In still another embodiment, a slickline percussion firing system may be employed in lieu of the electric line firing system to ignite the charges 78. This system comprises a slickline cable head connection for supporting the modified apparatus 321 and which is connected to a pressure firing subassembly. The pressure firing subassembly comprises a cylinder having the piston and spring described in connection with the battery firing system. Ports are formed through the cylinder wall above the piston. Fluid pressure is increased, to force the piston rod (firing pin) against a lower percussion firing cap which ignites upon impact to ignite the charges 78.

Also a percussion firing system run via coiled tubing, production tubing, or drill pipe may be employed in lieu of the electric firing system to ignite the charges 78. This system comprises coiled tubing for supporting the modified apparatus 321 connected to a connector subassembly which connects to a pressure firing head which comprises a hollow cylinder with a piston located therein and supported by shear pins. The coiled tubing is coupled to the interior of the cylinder at its upper end. The piston has a central flow path extending axially downward from its upper end and then radially outward through the cylinder wall. A firing pin extends from the lower end of the piston. The flow path allows the coiled tubing to fill with water as the assembly is lowered downhole and also allows for circulation of fluid in running of the assembly. When the apparatus is at the desired cutting depth, a ball is dropped into the tubing which passes to the piston, plugging the flow path allowing an increase in fluid pressure to be achieved in the tubing and upper end of the cylinder which shears the shear pins driving the firing pin into the percussion cap to ignite the charges 78.

What is claimed is:

1. An apparatus for use for severing a metal conduit disposed in a borehole extending downward into the earth, comprising:

a body adapted to be lowered into the metal conduit to be severed, said body comprising a surrounding wall defining an elongated chamber with a central axis and having a lower portion, an intermediate portion, and an upper portion, said lower portion defining a cavity with a plurality of apertures extending through said wall in a given plane at angularly spaced apart positions located 360° around said axis for providing passages from said cavity to the outside of said wall, a combustible charge located in said intermediate portion, a movable seal means located in said cavity above said apertures next to and below said combustible charge, and an ignition means coupled to said upper portion for igniting said combustible charge for creating a flame and hot combustion products for moving said movable seal means in said cavity below said apertures for passage of said flame and hot combustion products into said cavity and out of said apertures for severing the surrounding metal conduit.

2. The apparatus of claim 1, wherein:

said combustible charge comprises a pyrotechnic charge.

3. The apparatus of claim 1, wherein:

said combustible charge comprises a plurality of pyrotechnic charges.

4. The apparatus of claim 1, wherein:

said seal means supports said combustible charge in said intermediate portion of said chamber prior to ignition.

5. The apparatus of claim 4, wherein:

said charge comprise a pyrotechnic charge.

6. The apparatus of claim 5, wherein:

said combustible charge comprises a plurality of pyrotechnic charges.

7. The apparatus of claim 6, wherein:

said seal means supports said plurality of pyrotechnic charges in said intermediate portion of said chamber prior to ignition with at least one of said pyrotechnic charges engaging said seal means.

8. An apparatus for use for severing a metal conduit located in a borehole extending downward into the earth, comprising;

a body adapted to be lowered into the metal conduit to be severed, said body comprising a surrounding wall defining an elongated chamber with a central axis, said chamber having a plurality of apertures extending through said wall in a given plane at angularly spaced apart positions located 360 around said axis for providing passages from said chamber to the outside of said wall, a movable member located in said cavity and having at least one seal which engages said wall above said apertures, a combustible charge located in said chamber above and next to said movable member, an ignition means coupled to said chamber for igniting said combustible charge for creating a flame and hot combustion products for moving said movable member and said seal below said apertures to allow the passage of said flame and hot combustion products out of said apertures for severing the conduit.

9. The apparatus of claim 8, wherein:

said combustible charge comprises a pyrotechnic charge.

10. The apparatus of claim 8, wherein:

said combustible charge comprises a plurality of pyrotechnic charges.

11. The apparatus of claim 8, wherein:

said movable member supports said combustible charge in said chamber prior to ignition.

12. The apparatus of claim 11, wherein:

said charge comprise a pyrotechnic charge.

13. The apparatus of claim 12, wherein;

said combustible charge comprises a plurality of pyrotechnic charges.

14. The apparatus of claim 13, wherein:

said movable member supports said plurality of pyrotechnic charges in said intermediate portion of said chamber prior to ignition with at least one of said pyrotechnic charges engaging said movable member.

15. An apparatus for use for severing a conduit located in a borehole extending downward into the earth, comprising:

a body adapted to be lowered into the conduit to be severed, said body comprising a surrounding wall defining an elongated chamber with a central axis, said chamber having a plurality of apertures extending through said wall at angularly spaced apart positions located around said axis for providing passages from said chamber to the outside of said wall, a movable member located in said cavity and having means which forms a seal with said wall above said apertures, a combustible charge located in said chamber above and next to said movable member, an ignition means coupled to said chamber for igniting said combustible charge for creating a flame and hot combustion products for moving said movable member below said apertures to allow the passage of said flame and hot combustion products out of said apertures for severing the surrounding conduit.

16. The apparatus of claim 15, wherein:

said combustible charge comprises a pyrotechnic charge.

17. The apparatus of claim 15, wherein:

said combustible charge comprises a plurality of pyrotechnic charges.

18. The apparatus of claim 15, wherein:

said movable member supports said combustible charge in said chamber prior to ignition.

19. The apparatus of claim 18, wherein:

said charge comprise a pyrotechnic charge.

20. The apparatus of claim 19, wherein:

said combustible charge comprises a plurality of pyrotechnic charges.

* * * * *